US008719985B2

(12) United States Patent
Park et al.

(10) Patent No.: US 8,719,985 B2
(45) Date of Patent: May 13, 2014

(54) CONTROL METHOD OF WASHING MACHINE

(75) Inventors: Chang Joo Park, Seoul (KR); Soon Bae Yang, Seongnam-si (KR); Jun Hyun Park, Daegu (KR); Jung Chul Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1088 days.

(21) Appl. No.: 12/453,515

(22) Filed: May 13, 2009

(65) Prior Publication Data

US 2010/0011514 A1 Jan. 21, 2010

(30) Foreign Application Priority Data

Jul. 21, 2008 (KR) ..... 10-2008-0070684

(51) Int. Cl.
*D06F 35/00* (2006.01)

(52) U.S. Cl.
USPC ..... 8/158; 8/159

(58) Field of Classification Search
USPC ..... 8/158–159
See application file for complete search history.

(56) References Cited

U.S. PATENT DOCUMENTS

2003/0041390 A1* 3/2003 Kim et al. ..... 8/158
2004/0010860 A1* 1/2004 Johanski et al. ..... 8/158

FOREIGN PATENT DOCUMENTS

KR 10-2004-0046082 6/2004

* cited by examiner

*Primary Examiner* — Jason Ko
(74) *Attorney, Agent, or Firm* — Staas & Halsey LLP

(57) ABSTRACT

A control method of a washing machine, in which a hydraulic pressure of water supplied into the washing machine is estimated, enabling sensing of a laundry weight and measurement of a supply amount of the water. The control method includes calculating a first water supply time required to initially supply water to a setup water level, calculating a second water supply time required to additionally supply water according to a variation in water level due to laundry wetting after the initial supply of water, sensing a laundry weight according to a ratio of the first water supply time to the second water supply time, and measuring a flow rate of water using the amount of water supplied to the setup water level and the laundry weight data.

7 Claims, 8 Drawing Sheets

CONTROL METHOD OF WASHING MACHINE

CROSS-REFERENCE TO RELATED APPLICATIONS

This application claims the benefit of Korean Patent Application No. 10-2008-0070684, filed on Jul. 21, 2008 in the Korean Intellectual Property Office, the disclosure of which is incorporated herein by reference.

BACKGROUND

1. Field

Embodiments of the present invention relate to a washing machine and a control method thereof, and, more particularly, to a control method of a washing machine, in which a hydraulic pressure of water supplied into the washing machine is sensed, enabling sensing of a laundry weight and measurement of the supplied amount of water.

2. Description of the Related Art

Generally, a washing machine (typically, a drum type washing machine) includes a water tub in which water (i.e. wash water or rinse water) is received, a drum rotatably installed in the water tub to receive wash laundry (hereinafter, referred to as "laundry"), and a motor to generate a drive force required to rotate the drum. In operation of the washing machine, laundry received in the cylindrical drum can be washed as it is repeatedly raised and dropped along an inner wall of the drum during rotation of the drum.

The washing operation of the washing machine is composed of a series of strokes, for example, washing, rinsing, and dehydrating strokes. The washing stroke separates contaminants from laundry using water (i.e. wash water) in which detergent is dissolved. The rinsing stroke rinses bubbles or residual detergent out of the laundry using water (i.e. rinse water) containing no detergent. Also, the dehydrating stroke dehydrates the laundry at a high speed. To wash laundry via the series of strokes, the washing machine must sense a weight of laundry (hereinafter, referred to as a "laundry weight"). The sensed information of laundry weight is utilized as fundamental information to set the amount of water required for washing and rinsing strokes.

Various methods to sense a laundry weight have been proposed up to now. In one exemplary conventional washing machine, a laundry weight is sensed, based on three load levels of high, medium, and low, using a wetting stroke implementation time or using a total turn-on time of a water supply valve until a wetting stroke to uniformly wet laundry ends. Specifically, a longer total turn-on time of the water supply valve or wetting stroke implementation time is sensed as a high load level, and a shorter total turn-on time of the water supply valve or wetting stroke implementation time is sensed as a low load level.

However, the total turn-on time of the water supply valve or the wetting stroke implementation time is a value dependent on a hydraulic pressure of water supplied to a washing machine. If the hydraulic pressure is low, the water supply valve must be turned on for a long time despite that a desired supply amount of water is small. Therefore, even if an actual laundry weight corresponds to a low load level, the total turn-on time of the water supply valve increases, causing the washing machine to erroneously sense a high load level. On the contrary, if the hydraulic pressure is high, the water supply valve must be turned on for a short time despite that a desired supply amount of water is large. Therefore, even if an actual laundry weight corresponds to a high load level, the total turn-on time of the water supply valve decreases, causing the washing machine to erroneously sense a low load level.

SUMMARY

Accordingly, it is an aspect of embodiments of the present invention to provide a control method of a washing machine, in which a hydraulic pressure of water supplied in the initial supply stage is sensed, enabling accurate sensing of a laundry weight and measurement of a supply amount of the water regardless of the hydraulic pressure.

Additional aspects and/or advantages will be set forth in part in the description which follows and, in part, will be apparent from the description, or may be learned by practice of the invention.

In accordance with an aspect of embodiments of the present invention, the above and/or other aspects can be achieved by the provision of a control method of a washing machine comprising a water tub and a drum rotatably installed in the water tub, the method including determining whether or not to perform a wetting stroke, rotating the drum upon determining to perform the wetting stroke, opening a water supply valve during rotation of the drum, to initially supply water into the water tub, and sensing a variation in water level due to the wetting stroke, to additionally supply water into the water tub if the variation in water level is sensed and to stop the additional supply of water if the variation in water level is not sensed.

The rotation of the drum may begin prior to the opening of the water supply valve, or at least simultaneously with the opening of the water supply valve.

The control method may further include calculating an open time of the water supply valve until the initially supplied water reaches a setup water level, and estimating a hydraulic pressure of water supplied to the washing machine based on the open time of the water supply valve.

The control method may further include calculating an accumulated open time of the water supply valve when additional water is supplied according to the variation in water level after the initial supply of water, and sensing laundry weight according to a ratio of the open time to the accumulated open time of the water supply valve.

The control method may further include storing a value of the amount of initially supplied water supplied reaching the setup water level, and measuring a flow rate of water supplied to the washing machine using the stored value of the amount of initially supplied water and the laundry weight.

The open time and the accumulated open time of the water supply valve may be inversely proportional to the hydraulic pressure of water supplied to the washing machine.

In accordance with another aspect of embodiments of the present invention, there is provided a control method of a washing machine including calculating a first water supply time required to initially supply water to a setup water level, calculating a second water supply time required to additionally supply water according to a variation in water level due to laundry wetting after the initial supply of water, and sensing a laundry weight according to a ratio of the first water supply time to the second water supply time.

The calculation of the first water supply time may include rotating a drum during the initial supply of water, opening a water supply valve during rotation of the drum, to supply water, and calculating an open time of the water supply valve until the supplied water reaches the setup water level.

The rotation of the drum may begin prior to the opening of the water supply valve, or at least simultaneously with the opening of the water supply valve.

The setup water level may be a level at which the water is supplied only into a water tub without entering the drum.

The second water supply time may be an accumulated value of an open time of the water supply valve from a time point at which the water reaches the setup water level to a laundry wetting ending time point.

The open time and the accumulated open time of the water supply valve may be inversely proportional to a hydraulic pressure of water supplied to the washing machine.

The sensing of the laundry weight may be sensed using an Equation 1 defined as Laundry Weight=TFeedSum/TSB (where, TSB is the first water supply time and TFeedSum is the second water supply time).

The control method may further include storing a value of the amount of water supplied to the setup water level, and measuring a flow rate of water supplied to the washing machine using the stored value of the amount of water supplied to the setup water level and the laundry weight.

The flow rate of water supplied to the washing machine may be measured using an Equation 2 defined as Flow Rate (I)=Laundry Weight×K=(TFeedSum/TSB)×K (where, K is the stored value of the amount of water).

In accordance with a further aspect of embodiments of the present invention, there is provided a control method of a washing machine including determining whether or not to perform laundry wetting, rotating a drum upon determining to perform the laundry wetting, opening a water supply valve during rotation of the drum, to supply water, calculating an open time of the water supply valve until the supplied water reaches a setup water level, calculating an accumulated open time of the water supply valve from a time point at which water reaches the setup water level to a laundry wetting ending time point, and sensing a laundry weight according to a ratio of the open time to the accumulated open time of the water supply valve.

The sensing of the laundry weight may be sensed using an Equation 1 defined as Laundry Weight=TFeedSum/TSB (where, TSB is the first water supply time and TFeedSum is the second water supply time).

In accordance with a further aspect of embodiments of the present invention, there is provided a control method of a washing machine including sensing a hydraulic pressure of water supplied, determining a laundry weight of laundry in the washing machine based on the hydraulic pressure, and supplying an appropriate amount of water based on the laundry weight.

The sensing a hydraulic pressure of water may include determining a first time required to supply water to the washing machine to meet a maximum level of water before adsorption of water into the laundry, and determining a second time from the first time to a point in time when laundry in the washing machine is saturated with water.

The determining the laundry weight may evaluate an equation defined as laundry weight=the first time/the second time.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
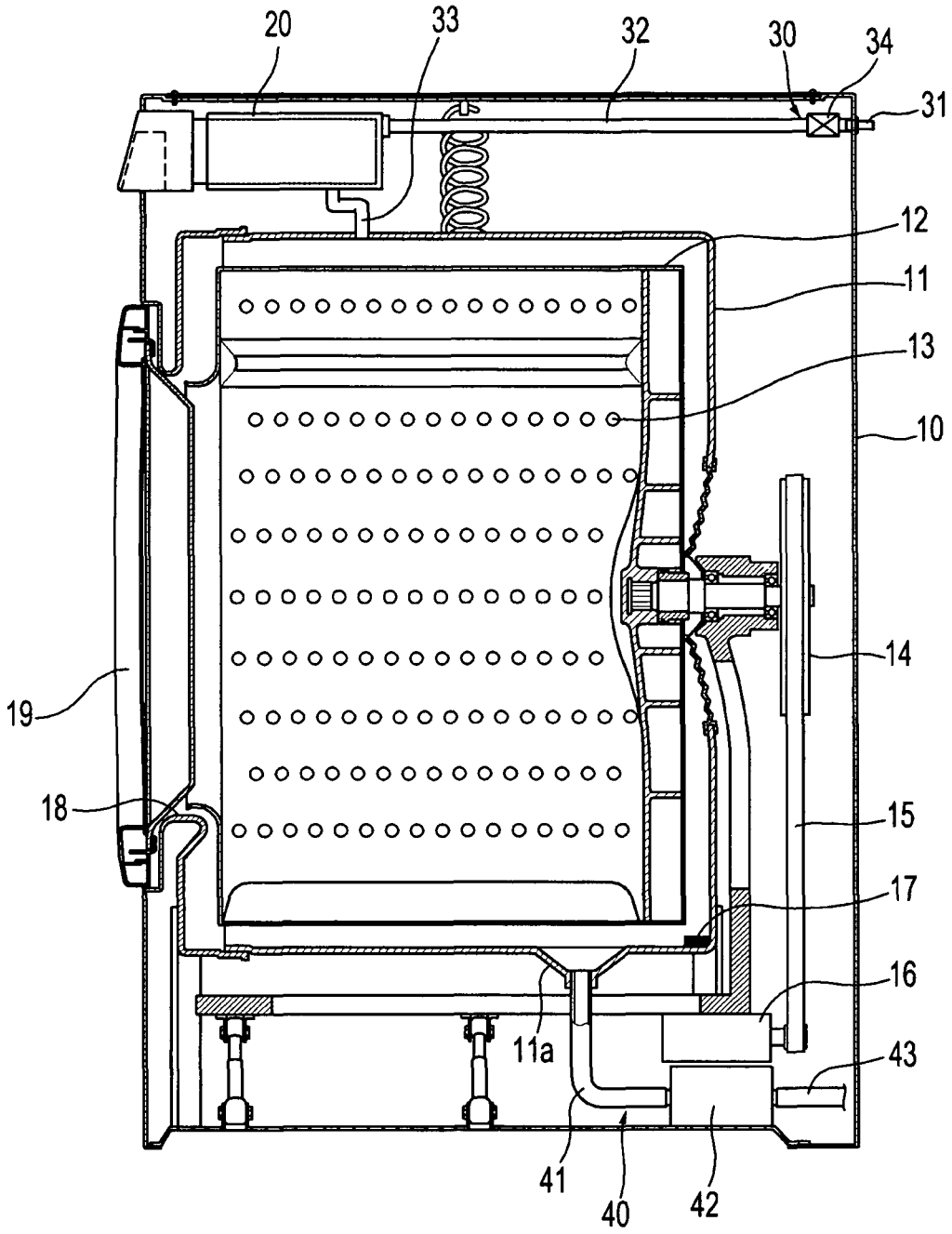
FIG. 1 illustrates a sectional view of the configuration of a washing machine according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

FIG. 1 illustrates a sectional view of the configuration of a washing machine according to an embodiment of the present invention.

As shown in FIG. 1, the washing machine of embodiments of the present invention include a drum type water tub 11 installed in a body 10, in which water (i.e. wash water or rinse water) is received, and a cylindrical drum 12, which is rotatably installed in the water tub 11 and has a plurality of dehydrating holes 13.

A motor 16 is installed below the water tub 11 and is used to rotate the drum 12 for implementation of washing, rinsing and dehydrating strokes. For this, the motor 16 transmits a drive force, via a rubber belt 15, to a pulley 14 connected to the drum 12. A water level sensor 17 is disposed on the bottom of the water tub 11 and is used to sense the variance of a water level frequency versus a water level, in order to sense the amount of water (i.e. water level) supplied into the water tub 11.

The body 10 is formed, at a front side thereof, with an entrance 18 to insert or remove laundry into or from the drum 12, and a door 19 is installed to the entrance 18.

A detergent supply device 20 to supply a detergent and a water supply device 30 to supply water (i.e. wash water or rinse water) are installed above the water tub 11.

The interior of the detergent supply device 20 is divided into a plurality of spaces. To allow a user to easily put a detergent and rinse agent into the respective spaces, the detergent supply device 20 is located toward the front side of the body 10.

The water supply device 30 to supply water (i.e. wash water or rinse water) into the water tub 11 includes a first water supply pipe 32 connecting an external water supply pipe 31 to the detergent supply device 20, a second water supply pipe 33 connecting the detergent supply device 20 to the water tub 11, and a water supply valve 34 installed on the first water supply pipe 32 to control the supply of water. With this configuration, water passes through the detergent supply device 20 prior to being supplied into the water tub 11, allowing the detergent in the detergent supply device 20 to be supplied into the water tub 11 together with the water.

A drainage device 40 is installed to drain the water received in the water tub 11. To guide the water of the water tub 11 to the outside, the drainage device 40 includes a first drainage pipe 41 connected to a drain hole 11*a* perforated in the bottom of the water tub 11, a drainage pump 42 installed on the first drainage pipe 41, and a second drainage pipe 43 connected to an exit of the drainage pump 42.

Figure 2:
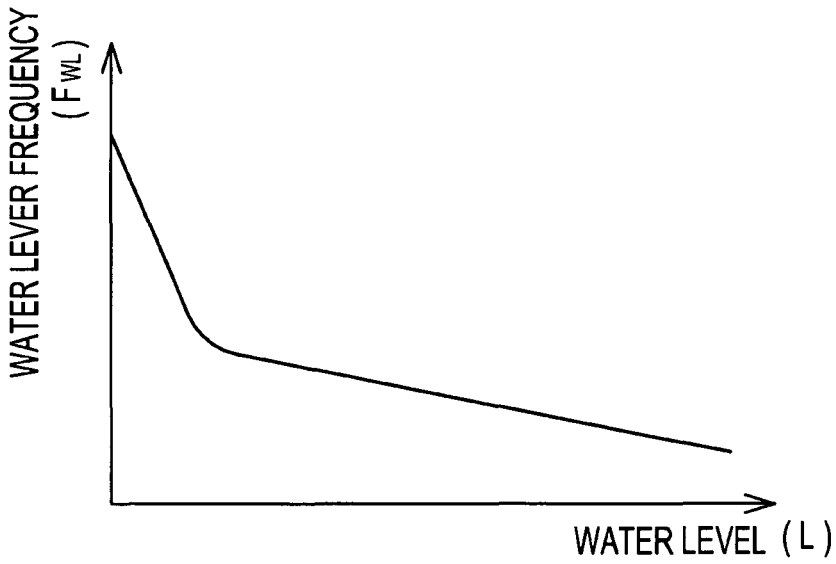
FIG. 2 illustrates a frequency waveform of a water level sensor according to an embodiment of the present invention.

FIG. 2 illustrates the frequency waveform of a water level sensor according to an embodiment of the present invention, and illustrates the relationship between the amount of water (i.e. water level, L) supplied into the water tub 11 (FIG. 1) and an output frequency (i.e. water level frequency, $F_{WL}$) of the water level sensor 17 (FIG. 1).

It can be appreciated from FIG. 2 that the water level is inversely proportional to the water level frequency.

Figure 3:
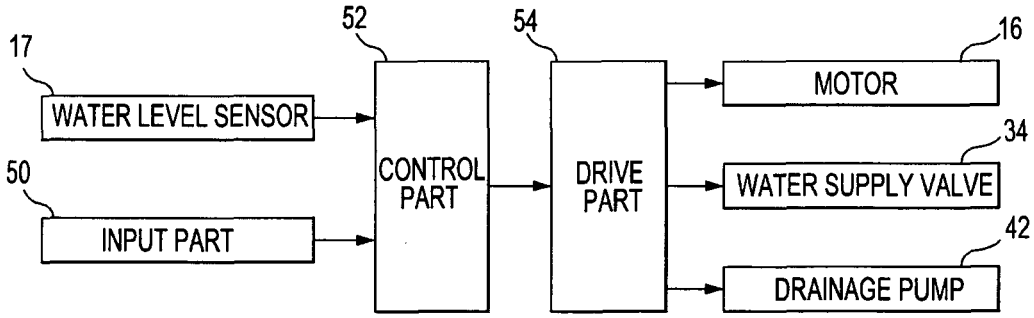
FIG. 3 illustrates a control block diagram of the washing machine according to an embodiment of the present invention.

FIG. 3 illustrates a control block diagram of the washing machine according to an embodiment of the present invention, illustrating an input part 50, a control part 52, and a drive part 54.

The input part 50 is used to input operating information selected by the user, such as a desired washing course, dehydrating RPM, addition of a rinsing operation, etc., into the control part 52.

The control part 52 is a microcomputer to control the general operation of the washing machine, such as washing, rinsing, dehydrating operations, etc., according to the operating information input from the input part 50. The control part 52 senses a hydraulic pressure of water, initially supplied into the washing machine, using a time required to supply the water to a first water level, i.e. a turn-on time $T_{SB}$ of the water supply valve 34 to reach a hydraulic pressure sensing water level $F_{WL_SB}$. Here, the water level $F_{WL_SB}$ is a minimum water level, to which e.g. approximately 5 liters of water required to sense a hydraulic pressure, is supplied close to the bottom of the drum without a risk of entering the drum). With the use of the sensed hydraulic pressure, the control part 52 can sense a laundry weight (more particularly, a weight of dry laundry) and also, can measure the amount of water (flow rate) supplied into the washing machine.

The drive part 54 is used to drive, for example, the motor 16, water supply valve 34, and drainage pump 42, according to drive control signals from the control part 52.

Now, the operation of the control part 52 will be described in detail with reference to FIG. 4.

Figure 4:
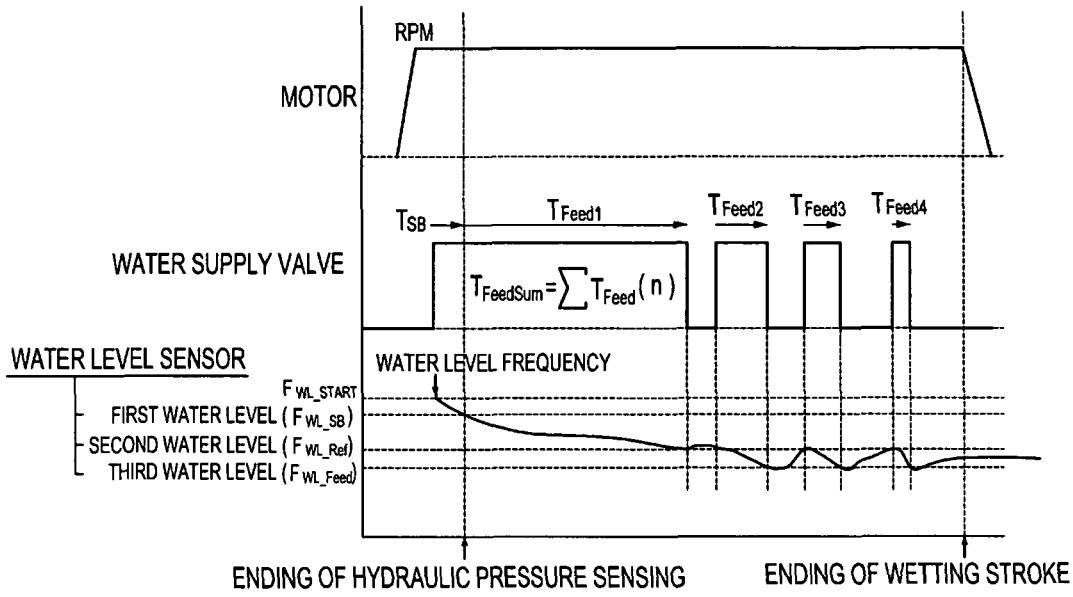
FIG. 4 illustrates a graph of a wetting stroke profile sensing a laundry weight in the washing machine according to an embodiment of the present invention.

FIG. 4 illustrates a graph of a wetting stroke profile sensing a laundry weight in the washing machine according to an embodiment of the present invention. Specifically, FIG. 4 illustrates a process sensing a laundry weight during a wetting stroke that uniformly wets laundry, on the basis of rotations of the motor 16 (FIG. 1) and drum 12 (FIG. 1), turn-on/turn-off operations of the water supply valve 34 (FIG. 1), and water levels sensed by the water level sensor 17 (FIG. 1).

Referring to FIGS. 1, 3 and 4, the control part 52 senses a hydraulic pressure of water using the turn-on time $T_{SB}$ of the water supply valve 34 to reach the first water level $F_{WL_SB}$ in the initial supply of water, i.e. an open time of the water supply valve 34. In this case, the drum 12 must begin to rotate prior to supplying water (more particularly, prior to turning on the water supply valve 34, when a water level is at a starting level, $F_{WL_START}$), or at least simultaneously with supplying water (more particularly, at least simultaneously with turning on the water supply valve 34). Beginning to rotate the drum 12 prior to turning on the water supply valve 34 can prevent water received in the water tub 11 from entering the drum 12 due to centrifugal force. Thereby, supplying water to the first water level $F_{WL_SB}$ with substantially no water adsorbed into laundry is possible, and this can increase correlation between the supplied water and a water level (See FIG. 2). As a result of sensing the hydraulic pressure of water using the turn-on time $T_{SB}$ of the water supply valve 34 to reach the first water level $F_{WL_SB}$, it can be appreciated that the higher the hydraulic pressure, the shorter the turn-on time $T_{SB}$ of the water supply valve 34 to reach the first water level $F_{WL_SB}$, and the lower the hydraulic pressure, the longer the turn-on time $T_{SB}$ of the water supply valve 34 to reach the first water level $F_{WL_SB}$. On the basis of these results, the hydraulic pressure of water supplied into the washing machine can be sensed.

Also, after calculating the turn-on time $T_{SB}$ of the water supply valve 34 to reach the first water level $F_{WL_SB}$, the control part 52 keeps the water supply valve 34 in a turned-on state so as to continuously supply water until the water reaches a second water level $F_{WL_Ref}$. Here, the second water level $F_{WL_Ref}$ is a target water level for a wetting stroke. Once the water reaches the second water level $F_{WL_Ref}$, the water supply valve 34 is turned off. In this case, although the drum 12 is continuously rotated even after the water supply valve 34 is turned off, as the water level rises from the first water level $F_{WL_SB}$ to the second level $F_{WL_Ref}$, the water enters the drum 12 to thereby be adsorbed into laundry. Thus, the water level drops, and the water supply valve 34 must be turned on so as to supplement water to a third water level $F_{WL_Feed}$. Here, the third water level $F_{WL_Feed}$ is a supplementary water level to supplement water when the water level drops during the wetting stroke). Once the water reaches the third water level $F_{WL_Feed}$, the water supply valve 34 is turned off. The water supply valve 34 will be again turned on to supplement water to the third water level $F_{WL_Feed}$ if the water level again drops after the lapse of a predetermined time of e.g. approximately 1~2 minutes (because the water is adsorbed into laundry). In this way, the water supply valve 34 is repeatedly turned on and off to effectively perform the wetting stroke, and the wetting stroke ends if the laundry is sufficiently wet. That is, if there is no variation in water level for a predetermined time, this means that laundry is sufficient wet and does not adsorb water any more, and the sufficient wetting of laundry can be determined.

After the laundry is sufficiently wet and the wetting stroke ends, the control part 52 calculates a total turn-on time $T_{FeedSum}$ of the water supply valve 34 during the wetting stroke. Here, the total turn-on time $T_{FeedSum}$ is a sum $[T_{FeedSum}=\Sigma T_{Feed}(n)]$ of turn-on times $T_{Feed1}$, $T_{Feed2}$, $T_{Feed3}$, $T_{Feed4}$, etc., of the water supply valve 34 from a time point at which the water reaches the first water level ($F_{WL_SB}$) (i.e. a hydraulic pressure sensing ending time point) to a wetting stroke ending time point, and more particularly, is an accumulated open time of the water supply valve 34. With the use of the calculated total turn-on time $T_{FeedSum}$ of the water supply valve 34 and the following Equation 1, a laundry weight can be sensed.

$$\text{Laundry Weight}=T_{FeedSum}/T_{SB} \qquad \text{Equation 1:}$$

In the Equation 1, if the hydraulic pressure is low, the total turn-on time $T_{FeedSum}$ of the water supply valve 34 during the wetting stroke increases and simultaneously, the turn-on time $T_{SB}$ of the water supply valve 34 to reach the first water level $F_{WL_SB}$ for sensing of the hydraulic pressure increases. Therefore, the laundry weight can be sensed regardless of whether the hydraulic pressure is low, or whether the hydraulic pressure is high. On the other hand, if the hydraulic pressure is high, the total turn-on time $T_{FeedSum}$ of the water supply valve 34 during the wetting stroke decreases and simultaneously, the turn-on time $T_{SB}$ of the water supply valve 34 to reach the first water level $F_{WL_SB}$ for sensing of the hydraulic pressure decreases. As a result, similar to the case of low hydraulic pressure, the laundry weight can be accurately sensed regardless of whether the hydraulic pressure is low, or whether the hydraulic pressure is high.

In addition, the control part 52 can measure the amount of water (flow rate) supplied into the washing machine using a previously experimentally measured value of the amount of water supplied to the first water level $F_{WL_SB}$. Specifically, defining the previously experimentally measured value as a constant K, the flow rate can be calculated using the following Equation 2.

$$\text{Flow Rate } (I) = \text{laundry weight} \times K = (T_{FeedSum}/T_{SB}) \times K \qquad \text{Equation 2:}$$

Accordingly, the control part 52 can realize a flow rate sensor software to measure the amount of water (flow rate) supplied into the washing machine using the Equation 2.

Figure 5:
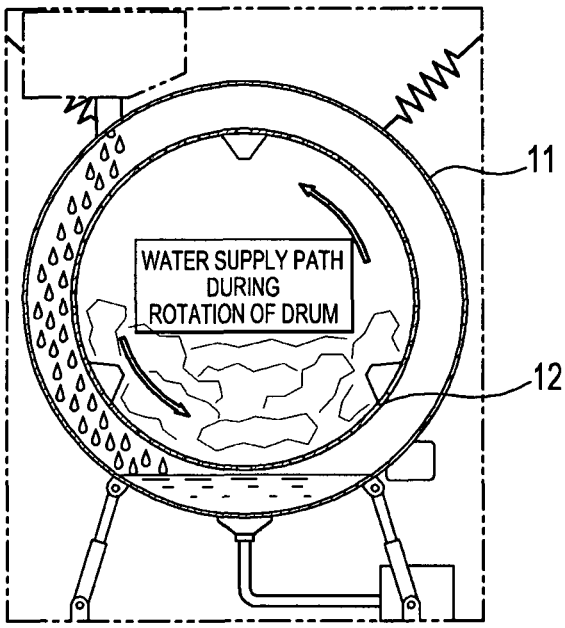
FIG. 5 illustrates a front view of the washing machine according to an embodiment of the present invention, showing a water supply path during rotation of a drum.
Figure 6:
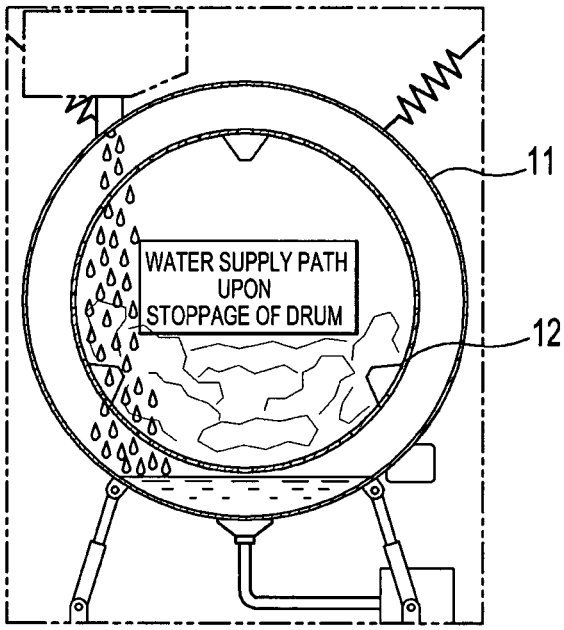
FIG. 6 illustrates a front view of the washing machine according to an embodiment of the present invention, showing a water supply path upon stoppage of the drum.

FIGS. 5 and 6 are front views of the washing machine according to embodiments of the present invention, illustrating a water supply path during rotation of the drum and a water supply path upon stoppage of the drum, respectively.

It can be appreciated from FIGS. 5 and 6 that the water received in the water tub 11 does not enter the drum 12 due to centrifugal force during rotation of the drum 12, and enters the drum 12 upon stoppage of the drum 12.

Referring to FIGS. 1, and 4-6, to sense the hydraulic pressure of water upon the initial supply of water, the time required to supply water to the first water level $F_{WL_SB}$, i.e. the turn-on time $T_{SB}$ of the water supply valve 34 to reach the hydraulic pressure sensing water level $F_{WL_SB}$ must be used. However, if the supplied water is adsorbed into laundry, it is impossible to accurately measure the turn-on time $T_{SB}$ of the water supply valve 34 to reach the hydraulic pressure sensing water level $F_{WL_SB}$. Therefore, rotating the drum 12 prior to turning on the water supply valve 34 is necessary to allow the water to fill the water tub 11 without a risk of entering the drum 12.

Figure 7A:
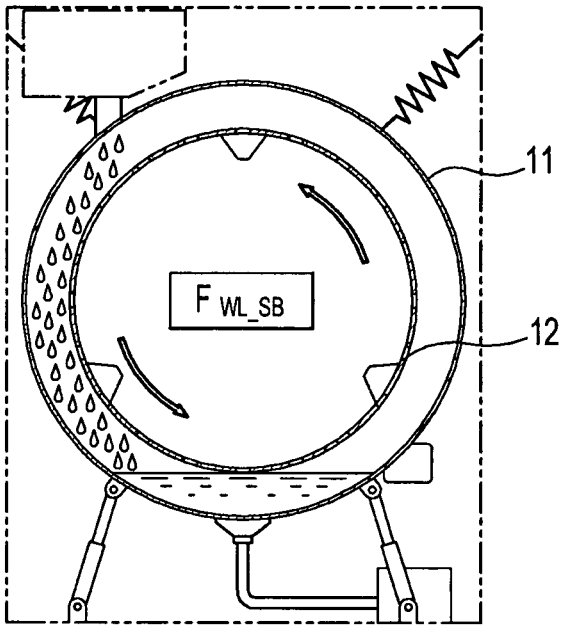
FIGS. 7A to 7C illustrate front views of the washing machine according to an embodiment of the present invention, showing different levels of water supplied to sense a laundry weight.
Figure 7B:
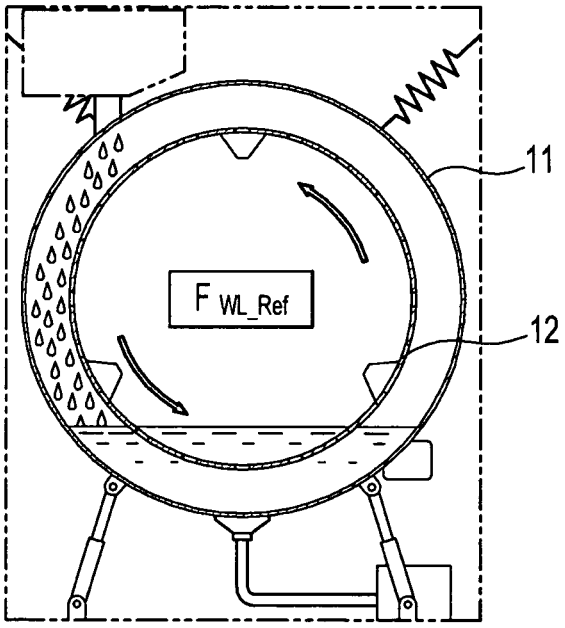
Figure 7C:
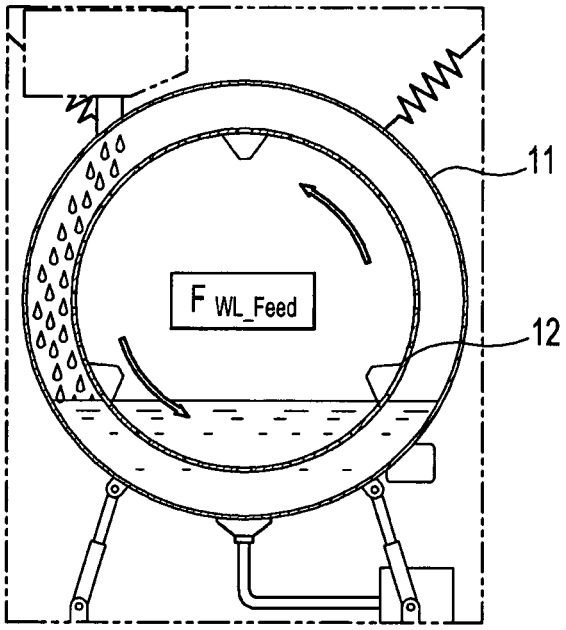

FIGS. 7A to 7C are front views of the washing machine according to embodiments of the present invention, illustrating different levels of water supplied to sense the laundry weight. More specifically, FIG. 7A illustrates the first water level $F_{WL_SB}$ to which water is supplied to sense the hydraulic pressure, FIG. 7B illustrates the second water level $F_{WL_Ref}$ to which water is supplied to perform the wetting stroke, and FIG. 7C illustrates the third water level $F_{WL_Feed}$ to which supplementary water is supplied when a water level drops because water is adsorbed into laundry during the wetting stroke.

In FIG. 7A, at the first water level $F_{WL_SB}$, water introduced into the water tub 11 fills only a bottom region of the water tub 11 and cannot enter the drum 12. Additionally, a slight amount of water entering the drum 12 to a water level corresponding to a height of 1~2 cm from the bottom of the drum 12, may also be considered a first water level $F_{WL_SB}$ as such an amount of water will not effect the control method.

Hereinafter, sequential operations of a control method of the washing machine having the above-described configuration and operational effects thereof will be described.

Figure 8A:
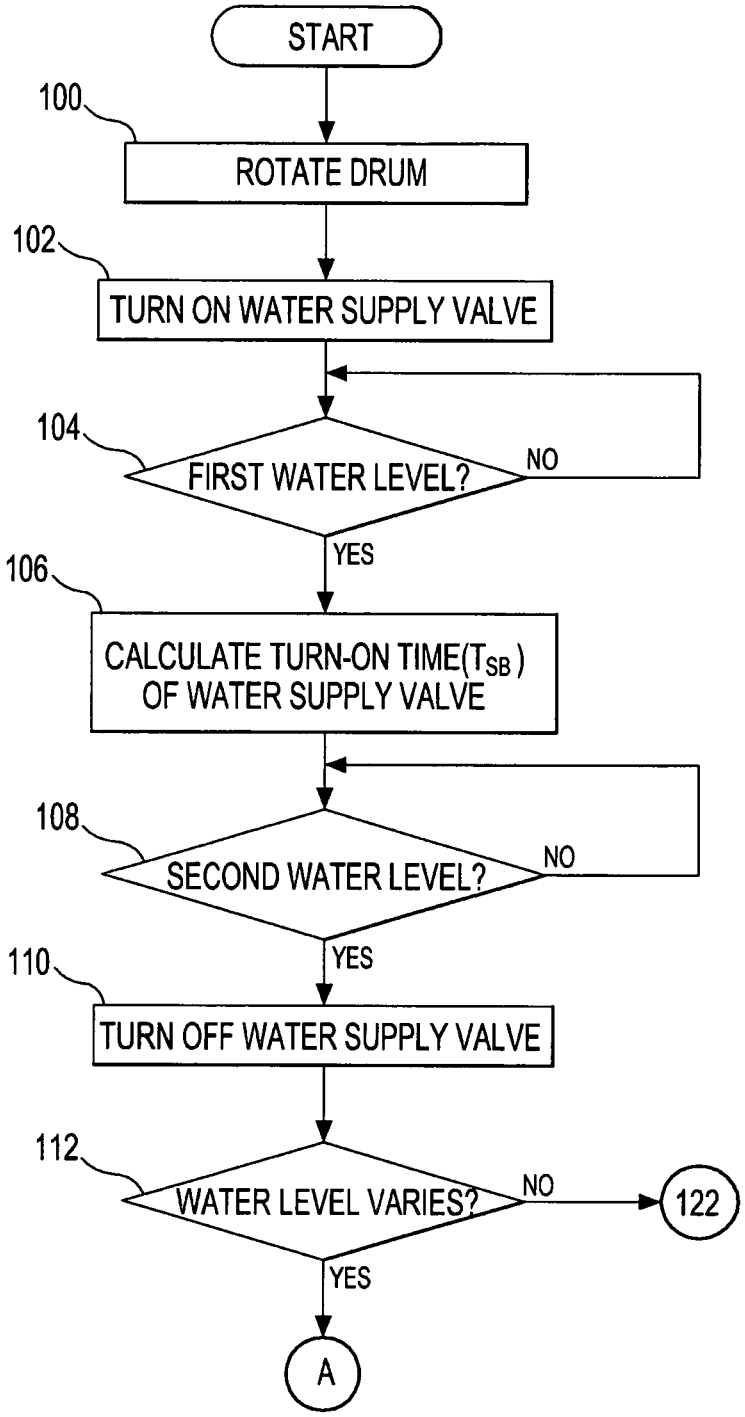
FIGS. 8A and 8B illustrate flow charts of a control method of the washing machine according to an embodiment of the present invention.
Figure 8B:
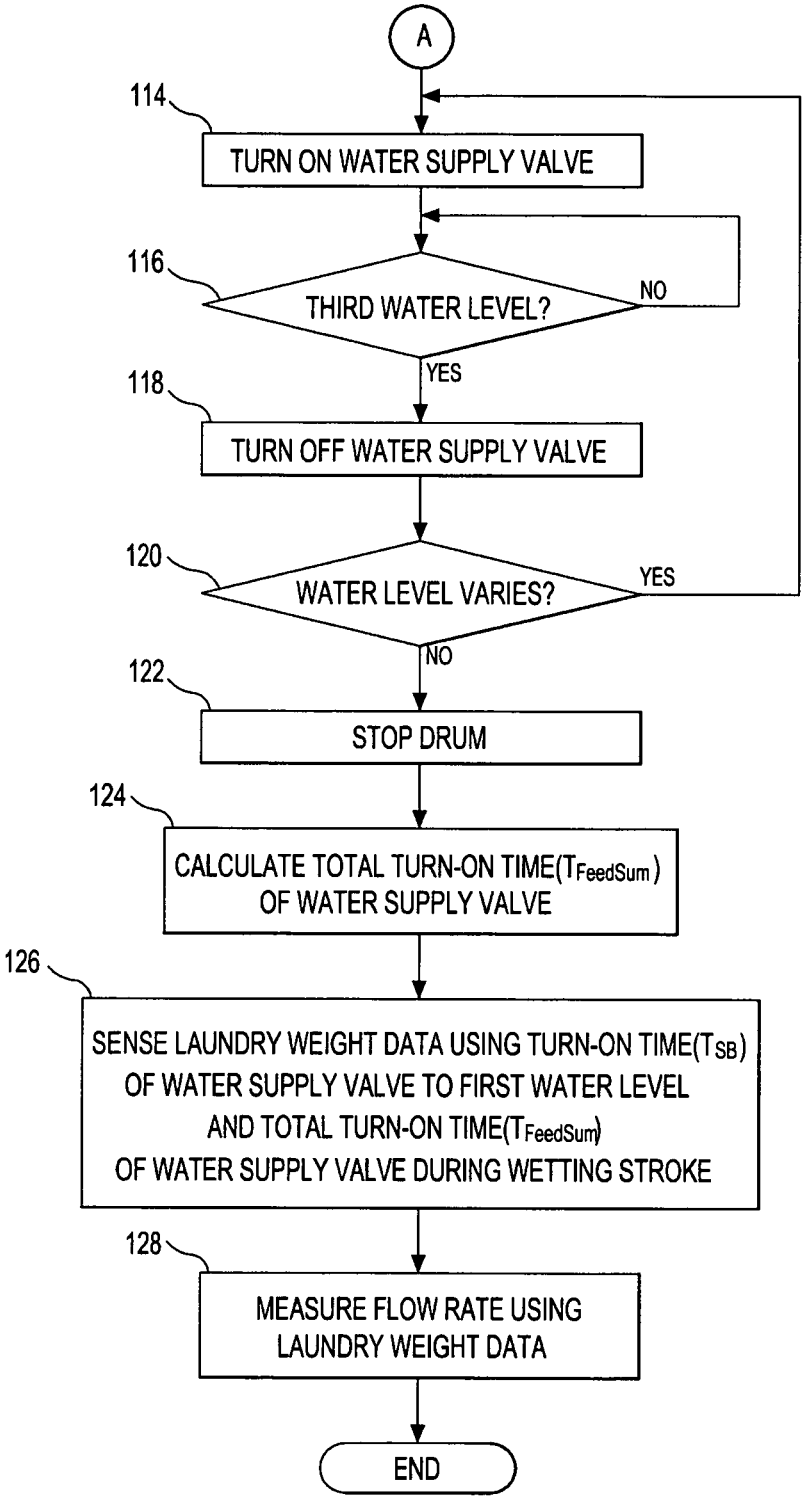

FIGS. 8A and 8B are flow charts illustrating a control method of the washing machine according to an embodiment of the present invention. Here, the accurate sensing of a laundry weight and the realization of a flow rate sensor software using a hydraulic pressure of water sensed upon the initial supply of water based on the wetting stroke profile will be described.

Referring to FIGS. 1, 3, 4, 8A and 8B, if the user selects operating information, such as a washing course, dehydrating RPM, addition of a rinsing operation, etc., according to the type of laundry placed in the drum 12, the selected operating information is input to the control part 52 through the input part 50.

To proceed through a series of operations implementing washing, rinsing and dehydrating strokes based on the operating information input through the input part 50, the control part 52 first performs a wetting stroke to sense a laundry weight.

In operation 100, the control part 52 controls operation of the motor 16 through the drive part 54 in order to perform the wetting stroke, so as to rotate the drum 12 at a predetermined RPM (approximately 35 RPM) as shown in FIG. 4.

In operation 102, if the drum 12 begins to rotate, the control part 52 turns on the water supply valve 34 via the drive part 54 in order to sense a hydraulic pressure of water upon the initial supply of water, thereby allowing water to be supplied into the water tub 11 through the opened water supply valve 34 and the first and second water supply pipes 32 and 33. In this case, the water, supplied into the water tub 11, cannot enter the drum 12 due to centrifugal force caused by rotation of the drum 12, and is gathered in the bottom region of the water tub 11 by way of a water supply path shown in FIG. 5.

In operation 104, the water level sensor 17 senses the level of water supplied into the water tub 11, to determine whether or not the water reaches the first water level $F_{WL_SB}$ as shown in FIG. 7A. If it is determined in operation 104 that the water does not reach the first water level $F_{WL_SB}$, the water is continuously supplied through the water supply valve 34.

If it is determined in operation 104 that the water reaches the first water level $F_{WL_SB}$, in operation 106, the control part 52 calculates the turn-on time $T_{SB}$ of the water supply valve 34 to reach the first water level $F_{WL_SB}$ as a hydraulic pressure sensing water level, i.e. the open time of the water supply valve 34. Also, the control part 52 keeps the water supply valve 34 in the turned on state, so as to continuously supply water required for the wetting stroke.

In operation 108, the water level sensor 17 senses the level of water supplied into the water tub 11, to determine whether or not the water reaches the second water level $F_{WL_Ref}$ as shown in FIG. 7B. If it is determined in operation 108 that the water does not reach the second water level $F_{WL_Ref}$, the water is continuously supplied through the water supply valve 34.

If it is determined in operation 108 that the water reaches the second water level $F_{WL_Ref}$, in operation 110, the control part 52 turns off the water supply valve 34 to stop the supply of water. In this case, although the drum 12 is continuously rotated, if the water level rises from the first water level $F_{WL_SB}$ to the second water level $F_{WL_Ref}$, the water enters the drum 12 to thereby be adsorbed into laundry and consequently, the water level drops.

In operation 112, the control part 52 determines via the water level sensor 17 whether or not the water level varies, and more particularly, whether or not the water level drops. In operation 114, if a variation in the water level is checked as shown in FIG. 4, the water supply valve 34 is again turned on to supplement water required for the wetting stroke.

In operation 116, the water level sensor 17 senses the level of water supplied into the water tub 11, to determine whether or not the water reaches the third water level $F_{WL_Feed}$ as shown in FIG. 7C. If it is determined in operation 116 that the water does not reach the third water level $F_{WL_Feed}$, the water is continuously supplied through the water supply valve 34.

If it is determined in operation 116 that the water reaches the third water level $F_{WL_Feed}$, in operation 118, the control part 52 turns off the water supply valve 34 to stop the supply of water. In this case, although the drum 12 is continuously rotated, if the water level rises from the second water level $F_{WL_Ref}$ to the third water level $F_{WL_Feed}$, the water enters the drum 12 to thereby be adsorbed into laundry with an increased flow rate and consequently, the water level drops. Once the laundry is sufficiently wet and does not adsorb water any more, there is no variation in the water level even after the lapse of a predetermined time.

In operation 120, the control part 52 determines via the water level sensor 17 whether or not the water level varies. If it is determined in operation 120 that a variation in the water level has occurred as shown in FIG. 4, the control part 52 returns to operation 114, to turn on the water supply valve 34 so as to supply water to the third water level $F_{WL_Feed}$. If it is determined in operation 120 that the water level reaches the third water level $F_{WL_Feed}$, the water supply valve 34 is turned off. In this way, the wetting stroke is performed via repeated turning on and off of the water supply valve 34.

If it is determined in operation 120 that no variation in the water level has occurred, in operation 122 the control part 52 determines that the laundry is sufficiently wet and as shown in FIG. 4, stops the drum 12 to end the wetting stroke.

Similarly, if is determined in operation 112 no variation in the water level has occurred, in operation 122, the control part 52 determines that the laundry is sufficiently wet and as shown in FIG. 4, stops the drum 12 to end the wetting stroke.

In operation 124, after the laundry is completely wet and the wetting stroke ends, the control part 52 calculates a sum $[T_{FeedSum}=\Sigma T_{Feed}(n)]$ of turn-on times $T_{Feed1}$, $T_{Feed2}$, $T_{Feed3}$, $T_{Feed4}$, etc, of the water supply valve 34 during the wetting stroke from a time point at which the water reaches the hydraulic pressure sensing water level $F_{WL_SB}$ to a wetting stroke ending time point, more particularly, an accumulated open time of the water supply valve 34.

Thereafter, in operation 126, the turn-on time $T_{SB}$, of the water supply valve 34 to reach the first water level $F_{WL_SB}$ as a hydraulic pressure sensing water level, and the total turn-on on time $T_{FeedSum}$ of the water supply valve 34, are evaluated within Equation 1 defined as Laundry Weight$=T_{FeedSum}/T_{SB}$, by the control part 52, in order to sense the laundry weight.

In Equation 1, if the hydraulic pressure is low, the total turn-on time $T_{FeedSum}$ of the water supply valve 34 during the wetting stroke increases and simultaneously, the turn-on time $T_{SB}$ of the water supply valve 34 to reach the first water level $F_{WL_SB}$ for sensing of the hydraulic pressure increases. Therefore, the laundry weight can be sensed regardless of the hydraulic pressure. If the hydraulic pressure is high, the total turn-on time $T_{FeedSum}$ of the water supply valve 34 during the wetting stroke decreases and simultaneously, the turn-on time $T_{SB}$ of the water supply valve 34 to reach the first water level $F_{WL_SB}$ for sensing of the hydraulic pressure decreases. As a result, similar to the case of low hydraulic pressure, the laundry weight can be accurately sensed regardless of the hydraulic pressure.

In addition, the control part 52 can measure the amount of water (flow rate) supplied into the washing machine using a previously experimentally measured value of the amount of water supplied to the first water level $F_{WL_SB}$. Specifically, defining the previously experimentally measured value as a constant K, the flow rate can be calculated using the Equation 2 defined as Flow Rate (I)=laundry weight×K=$(T_{FeedSum}/T_{SB})\times K$.

Accordingly, the control part 52 can realize a flow rate sensor software to measure the amount of water (flow rate) supplied into the washing machine using Equation 2.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A control method of a washing machine comprising a water tub and a drum rotatably installed in the water tub, the method comprising:

determining whether or not to perform a wetting stroke;

rotating the drum upon determining to perform the wetting stroke;

initially opening a water supply valve during rotation of the drum, to initially supply water into the water tub through a water supply path provided between the water tub and the drum so that the initially supplied water is prevented from being entered into the drum and being absorbed into laundry due to centrifugal force caused by the rotating of the drum;

closing the water supply valve when the initially supplied water reaches a hydraulic pressure sensing water level which is a minimum water level required to sense hydraulic pressure;

calculating an initial open time of the water supply valve until the initially supplied water reaches the hydraulic pressure sensing water level;

estimating the hydraulic pressure of the water supplied to the washing machine based on the initial open time of the water supply valve;

determining whether a variation in water level exists due to the wetting stroke; and opening the water supply valve to additionally supply water into the water tub if it is determined that the variation in water level exists and not opening the water supply level to stop the additionally supply water into the water tub if it is determined that the variation in water level does not exist, wherein the rotation of the drum begins prior to the initially opening of the water supply valve, and ends if it is determined that the variation in water level does not exist.

2. The method according to claim 1, wherein the rotation of the drum begins at least simultaneously with the initially opening of the water supply valve.

3. The method according to claim 1, further comprising:

calculating an accumulated open time of the water supply valve when additional water is supplied according to the variation in water level after the initial supply of water reaches the hydraulic pressure sensing water level, the accumulated open time being an accumulated value of an open time of the water supply valve from a time point at which the water reaches the hydraulic pressure sensing water level to a laundry wetting ending time point; and sensing laundry weight according to a ratio of the initial open time to the accumulated open time of the water supply valve.

4. The method according to claim 3, further comprising:

storing a value of the amount of initially supplied water reaching the hydraulic pressure sensing water level; and measuring a flow rate of water supplied to the washing machine using the stored value of the amount of initially supplied water and the laundry weight.

5. The method according to claim 3, wherein the initial open time and the accumulated open time of the water supply valve are inversely proportional to the hydraulic pressure of water supplied to the washing machine.

6. The method according to claim 3, wherein the sensing of the laundry weight is sensed using an Equation 1 defined as Laundry Weight=$T_{FeedSum}/T_{SB}$, $T_{SB}$ being the initial open time and $T_{Feed/Sum}$ being the accumulated open time.

7. The method according to claim 6, wherein the flow rate of water supplied to the washing machine is measured using an Equation 2 defined as Flow Rate (I)=Laundry Weight×K=($T_{Feed/Sum}/T_{SB}$)×K, K being the stored value of the amount of water supplied to the hydraulic pressure sensing water level.

* * * * *

UNITED STATES PATENT AND TRADEMARK OFFICE

CERTIFICATE OF CORRECTION

PATENT NO. : 8,719,985 B2
APPLICATION NO. : 12/453515
DATED : May 13, 2014
INVENTOR(S) : Chang Joo Park et al.

It is certified that error appears in the above-identified patent and that said Letters Patent is hereby corrected as shown below:

In the Claims

Column 11, Line 2, In Claim 6, delete "$T_{Freed/Sum}$" and insert -- $T_{FreedSum}$ --, therefor.

Column 11, Line 6, In Claim 7, delete "($T_{Freed/Sum}/T_{SB}$)" and insert -- ($T_{FreedSum}/T_{SB}$) --, therefor.

Signed and Sealed this
Fourth Day of November, 2014

Michelle K. Lee

Michelle K. Lee
*Deputy Director of the United States Patent and Trademark Office*